US011796143B2

(12) United States Patent
Gielen

(10) Patent No.: US 11,796,143 B2
(45) Date of Patent: Oct. 24, 2023

(54) LUMINAIRE, SUSPENSION MEANS AND METHODS FOR SUSPENDING, RESPECTIVELY DEMOUNTING A LUMINAIRE

(71) Applicant: SIGNIFY HOLDING B.V., Eindhoven (NL)

(72) Inventor: Vincent Stefan David Gielen, Gastel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 58 days.

(21) Appl. No.: 17/614,975

(22) PCT Filed: May 28, 2020

(86) PCT No.: PCT/EP2020/064870
§ 371 (c)(1),
(2) Date: Nov. 29, 2021

(87) PCT Pub. No.: WO2020/245029
PCT Pub. Date: Dec. 10, 2020

(65) Prior Publication Data

US 2022/0243882 A1 Aug. 4, 2022

(30) Foreign Application Priority Data

Jun. 3, 2019 (EP) ..... 19177837

(51) Int. Cl.
*F21S 8/02* (2006.01)
*F21V 21/04* (2006.01)

(52) U.S. Cl.
CPC ..... *F21S 8/026* (2013.01); *F21V 21/045* (2013.01); *F21V 21/046* (2013.01)

(58) Field of Classification Search
CPC ..... F21S 8/026; F21V 21/045; F21V 21/046; F21V 21/044
(Continued)

(56) References Cited

U.S. PATENT DOCUMENTS 7,607,795 B2 * 10/2009 Engel ..... F21S 8/02 362/147
8,544,807 B2 * 10/2013 Foreman ..... G08B 13/19619 248/323
(Continued)

FOREIGN PATENT DOCUMENTS

EP 2884161 A1 6/2015
JP 2015022934 A 2/2015

*Primary Examiner* — Laura K Tso

(57) ABSTRACT

Luminaire (1) comprising suspension means (3) and a housing (5) with a top wall (7). Said suspension means (3) comprising a hook (9*a, b*) formed of an elastic wire (11) with a loop portion (15) connected to two remote, oppositely arranged end portions (13*a, b*) each forming a spindle (17*a, b*), and two elongated channel elements (19*a, b*) arranged along a rotation axis (21) and mounted on the top wall (7), with each spindle (17*a, b*) being snugly fitted in a respective channel element (19*a, b*). By a mutual misalignment between the spindles (17*a, b*) and the channel element (19*a, b*) with respect to the rotation axis (21), the hook (9*a, b*) is in a low tension state when in a first rotational position (27), and in a high tension state when in further rotational positions (29) and urging the hook (9*a, b*) to assume the first rotational position (27).

14 Claims, 6 Drawing Sheets

(58) Field of Classification Search
USPC ..... 362/147, 148, 150, 364, 365, 366
See application file for complete search history.

(56) References Cited

U.S. PATENT DOCUMENTS

| | | | | |
|---|---|---|---|---|
| 2010/0265725 | A1* | 10/2010 | Wilcox | F21V 21/04 362/364 |
| 2012/0026743 | A1 | 2/2012 | Yasuoka et al. | |
| 2015/0085499 | A1* | 3/2015 | Mandy | F21V 21/046 362/365 |
| 2015/0267873 | A1 | 9/2015 | Price et al. | |
| 2016/0138789 | A1 | 5/2016 | Brown | |
| 2018/0003366 | A1 | 1/2018 | Halliwell | |
| 2018/0031212 | A1 | 2/2018 | Nguyen et al. | |

* cited by examiner

LUMINAIRE, SUSPENSION MEANS AND METHODS FOR SUSPENDING, RESPECTIVELY DEMOUNTING A LUMINAIRE

CROSS-REFERENCE TO PRIOR APPLICATIONS

This application is the U.S. National Phase application under 35 U.S.C. § 371 of International Application No. PCT/EP2020/064870, filed on May 28, 2020, which claims the benefit of European Patent Application No. 19177837.2, filed on Jun. 3, 2019. These applications are hereby incorporated by reference herein.

FIELD OF THE INVENTION

The invention relates to a luminaire. The invention further relates to a suspension means suitable for use in a luminaire. The invention still further relates to methods for suspending and demounting said luminaire.

BACKGROUND OF THE INVENTION

Luminaires providing convenient ambient lighting for commercial offices and industrial spaces, are commonly used in false or dropped ceilings and are typically referred to as troffer lighting luminaires. An example of such a troffer luminaire is disclosed in US20150267873A1. In many installations, these luminaires comprise one or more straight or U-shaped fluorescent lamps or TLEDs that span the length of the luminaire. Often these troffer luminaires are used as modular luminaires to build up light tiles and/or light lines of a false ceiling. Usually then these modular luminaires are tightly enclosed by neighboring modular luminaires and/or by neighboring false ceiling tiles.

With the aging of these luminaires, there is an increasing need or desire for servicing, i.e. upgrading, maintenance and eventually replacement, of the luminaire. Yet, servicing electronic parts and the lamps of troffer luminaires is often costly and time-consuming as thereto in many cases access to the recessed portion of the luminaire is required. Said access to the known luminaire involves the disadvantage that servicing is relatively difficult as said access is typically via a suspension construction of the luminaire comprising a removable or pivotable door frame. The luminaire comprising such a known suspension construction renders some of the electronic parts of the luminaire to be located on the vertical hanging door frame and/or parts of the luminaire to stay overhead in the recess in the false ceiling during the servicing, which renders the servicing cumbersome and involves the further disadvantage of an enhanced risk on parts or tools falling down.

EP2884161A1 discloses a lighting apparatus including an apparatus body and a light emitter unit having a pair of biasing members arranged on its top face and being arranged under the apparatus body, when hooked onto spring receiving pieces of the apparatus body said pair of biasing members generate a force of pulling up the light emitter unit upward to the apparatus body.

SUMMARY OF THE INVENTION

It is an object of the invention to provide a luminaire of the type as described in the opening paragraph in which at least one of the disadvantages of the known luminaire is counteracted. The invention relates to both a luminaire and a suspension means, the luminaire according to the invention comprises said suspension means. Hence, the suspension means is suitable for use in said luminaire, said suspension means comprising:

- a hook formed of an elastic wire/rod/tube of a cross-sectional diameter Dw and having two remote, essentially oppositely arranged end portions mutually connected by a loop portion, each end portion forming a spindle with length Ls,
- a base comprising two elongated channel elements axially arranged along a rotation axis,
- wherein in an assembled configuration of hook and base,
  - at least a portion of a respective spindle is accommodated with a snugly fit in a respective channel of a respective channel element, and
  - the spindles and/or the channels are mutually misaligned with respect to the rotation axis for the hook to be in a relatively low tension state when in a first rotational position, and to be in a relatively high tension state when in further rotational positions and wherein the hook is urged to rotate to assume the first rotational position.

Such a suspension means is applicable for any device, for example a lighting device, such as a luminaire, that needs to be suspended in a recess from a (false) ceiling or needs to be suspended flush with a (false) ceiling.

In the context of this invention the expression "elastic wire" means to include a spring wire, rod, a bar and/or a tube made of elastic material. The elastic material of wire can be one of spring steel, pre-hardened stock, typically used for small springs; annealed steel hardened after fabrication, usually used for larger springs; non-ferrous metals including phosphor bronze, titanium that are normally used when the material needs to be corrosion resistant; and beryllium copper typically used when good electrical conductance is desired. The elastic materials typically have a high yield strength and a high hardness to enable objects made of these elastic materials to return back to their original shape, despite significant deflection or twisting. Yield strength usually is expressed in Mega-Pascal (MPa), examples of suitable values are in the range of 400 MPa to 1500 MPa. Hardness is normally expressed as Rockwell hardness on the Hardness Rockwell C-scale (HRC). The higher the HRC the harder the material. Examples of suitable HRC-values for hardness are in the range of 40 HRC to 75 HRC.

Further in the context of this invention the expression "snugly fit" means fitting closely. In principle the channel in the channel element must have an internal cross-section diameter Dc>Dw, with Dw being the cross-section diameter of the wire/rod. Yet, to ease the insertion of the wire/rod into the channel and to avoid issues with insertion due to variation during manufacturing of the wire diameter, the channel in a channel element preferably has a cross-section diameter Dc with 1.03*Dw<=Dc<=1.10*Dw. Typically, 1 mm<=Dw<=5 mm, for example 3 mm. Still further in the context of the invention, the expression "top wall" means the wall of the housing that is facing upwards with respect to the gravity direction when the luminaire is in a suspended position.

The further rotational positions have as a common characteristics that the hook is in a relatively high tension state, i.e. in these positions the hook is elastically deformed, while in the first rotational position elastic deformation of the hook can be absent, but does not need to be absent but can be in a relatively low tension state. Preferably, also in the first rotational position a relatively small elastic deformation of the hook is present to have the hook resting on the wall of the housing with s small permanent pressure, for example to avoid rattling during transport of the luminaire. This can be obtained via suspension means wherein in the tension free (or relaxed) state a two-dimensionally shaped hook extends parallel to the top wall and rests on the top wall of the housing and then by slightly shaping the hook out of its two-dimensional shape by plastic deformation of the hook to bend slightly towards the wall of the housing, for example by bending at least one of the spindles out of plane with the legs, to bend the legs out of plane, and/or to bend the bridge out of plane.

The tension state is related to the hook and tension increases with an increasing rotation angle δ between the first rotational position and the further rotational position as a result of an increasing elastic deformation of the hook. The elastic deformation is caused by and/or a function of the misalignment of the spindles and/or the channels in combination with the snugly fit of the spindles in the channels and with the mutual rotational position over the rotation axis of the respective spindle and its associated channel. The elastic deformation causes a force that urges the hook to its first rotational position. This involves the beneficial effect that the urge to rotate from the further rotational positions into the first rotational position increases with increasing rotation angle δ and that when a luminaire is suspended from a false ceiling and in a lowered position, i.e. in a position where the luminaire is non recessed or not flush with the false ceiling, the rotation angle δ is relatively large. Hence, then the force that urges the hook to assume the low tension state and the luminaire to assume the recessed or flush position, is relatively large and hence only a small additional force by the installer is needed to mount the luminaire into its recessed/flush position. In the fully recessed/flush position of the luminaire, the hook is in or close to its first rotational position, i.e. the hook is in its relatively low tension state. As a result, demounting or bring the luminaire out of its recessed/flush position, requires only a relatively small force to be applied by the installer. Once the luminaire is brought out of its recessed/flush position into its lowered position, it is held by the suspension means in a horizontal position, essentially parallel and well below the false ceiling thus enabling easy and safe servicing of the luminaire. The luminaire according to the invention is in particular suitable to be used as a modular luminaire in false ceilings.

Conveniently, the luminaire comprises at least two suspension means that are mutually sufficiently spaced apart, for example in that each suspension means is provided halfway between a respective end and the center of the luminaire along the elongated direction of the luminaire. Thus, a stable recessed/flush mounted luminaire and stable suspended lowered position of the luminaire is obtained.

The luminaire might have the feature that the hook is shaped as an essentially two-dimensional body. The hook extends in a single plane and can then rest practically as a flat body against the top wall of the luminaire when the luminaire is in the recessed/flush position rendering the luminaire to have a relatively small built-in depth. Furthermore, it renders the luminaire to be relatively compact, which is convenient, for example for shipping or stock keeping of the luminaire. To render the luminaire more compact, the luminaire might have the feature that the top wall comprises a major, flat surface on which the channel elements are provided, and wherein in the first rotational position of the relatively low tension state the loop portion of the hook extends essentially parallel to said flat surface. Essentially parallel in this context means that the hook may extend at an angles β with the flat surface of at the most 10°.

The luminaire might have the feature that the loop portion comprises a bridge portion and two substantially parallel leg portions extending in the same direction, the bridge portion having two bridge ends, and each leg portion having at a respective second leg end a respective end portion as the spindle, the two leg portions are connected by a respective first leg end to a respective bridge end. In the context of this invention the expression "substantially parallel" means that the legs may extend at a mutual angle of at the most 20°. Alternatively or additionally, it means that at least one leg needs not to be perfectly straight but may have at least one profiled structure portion selected from a kink or slight bend of at the most 30°; an indent; a protrusion; and a step or stepped profile. Thus, a further rotational position which is semi-stable is provided, enabling a semi-stable resting rotational position. This is convenient when the suspension means is suspended in a lowered position from a false ceiling.

To improve easy servicing, the legs preferably have a leg length Ll of at least 8 cm, more preferably Ll>=10 cm. Preferably the leg length Ll is less than 25 cm, as with larger legs handling moves become too large and hence become cumbersome and involves an enhanced risk of exceeding the elastic deformation limit of the material of the hook, resulting in permanent plastic deformation. For the luminaire to be suspended stable in the lowered position, the legs of a single hook need to be spaced apart, said spaced apart is obtained via the bridge portion having a bridge length Lb. Said bridge length scales with the size of the luminaire and the size of the legs. Preferably the bridge length is related to the length of the legs according to: 0.5<=Ll/Lb<=2. Also the diameter of the wire Dw of the hook scales with the leg's length Ll, preferably a relation between legs length Ll and wire diameter Dw is according to 25<=Ll/Dw<=100. The spindles, one at each leg are spaced apart by a spindle spacing Ss according to: Ss=Lb±0.3Ll. The spindle can extend essentially towards each other or essentially can point away from each other. Also the bridge may be provided with at least one of said profiled structures.

The luminaire might have the feature that each spindle has a respective spindle axis and wherein the spindle axes are mutually angled at a misalignment angle α in the range of 5°<=α<=45°, preferably 15°<=α<=40°, most preferably 24°<=α<=36°. The misalignment angle α is a parameter for the misalignment of the spindles, and hence one of a plurality of parameters that determines the degree of tension state of the hook when in further rotational positions. Hence, it is a suitable parameter to control the tension (level) of the hook and the force by which the hook is urged to assume its first rotational (low tension state) position. Generally applies, that when the misalignment angle α increases, the misalignment and the tension of the hook in further rotational positions increase, particularly when the other parameters are set to normal values, i.e. the offset O is zero of both the spindles and the channels, the orientation of the channels is mutually parallel, and the relationship 1.03*Dw<=Dc<=1.10*Dw is fulfilled. Alternatively, it is possible that the angled position at misalignment angle α between the spindle axes is also present between the channels in the same orientation such that when the hook is in the first rotational position it is essentially tension free, while when it is in further rotational positions tension is present.

Similarly as the abovementioned parameter of angled spindle axes to control the tension (level) of the hook and the force by which the hook is urged to assume its first rotational position (low tension state), the luminaire might have the feature that each spindle has a respective spindle axis, wherein the spindle axes extend mutually essentially parallel and are mutually offset by an offset O, said offset O being n times the cross sectional diameter Dw of the elastic wire, with 2<=n<=15, preferably 3<=n<=12, most preferably 5<=n<=10. Preferably the offset O of the spindles and of the channels is the same, i.e. same in size and in direction such that when the hook is in the first rotational position it is essentially tension free, while when it is in further rotational positions tension stress is present. The leg portions may be of a different length, i.e. respectively Lla and Llb, wherein length Lla−O approximately matches with length Llb, for example 0.9*Llb<=Lla−O<=1.1*Llb. Preferably Lla−O=Llb, so that when the hook is in the first rotational position and rests on the housing wall, the difference in length of the leg portions matches with the offset O of the spindles, so that the hook is essentially in a tension free state in the first rotational position. When the hook is rotated into one of the further rotational positions, said offset and said length difference are out of mutual planes and the length difference in leg portions cannot compensate the offset which renders the hook to be in a relatively high tension state and to be urged back to the first rotational position.

The length of the spindle Ls, scales with the size of the hook (legs) to render the tension of the hook to scale with its size. Thereto, the luminaire might have the feature that said length Ls of each spindle is m times the cross sectional diameter Dw of the elastic wire, with 2<=m<=15, preferably 3<=m<=12, most preferably 5<=m<=10.

When bringing the hook from its first rotational position into further rotational positions, tension needs to be built up to obtain the force that urges the hook to return to its first rotational position. This force needs to be built up via elastic deformation of the hook. Thereto it is favorable to have the spindles of the hook to be snugly enclosed over a sufficient length by the channels. Hence, the luminaire might have the feature that the channel elements each comprise a respective channel having a length Lc, with Lc>=0.6*Ls (or 60%). It appeared that then a sufficient fixation of the spindles in the channels is obtained to keep them in an essentially unaltered position when the hook is rotated between first rotational position and further rotational positions. Preferably, the luminaire thereto might have the feature that at least 70% of each spindle is extending in a respective, associated channel element, preferably at least 85%.

The luminaire might have the feature that the channel elements are integral with a base element, said base element being attached to the top wall via separate attaching means such as via rivets, screws, solder and/or welds. This has the advantage that the position of the channels can be chosen in a late stage to optimize the configuration of the luminaire to actual circumstances. Alternatively, the luminaire might have the feature that the channel elements are integrally formed with the top wall of the luminaire. This has the advantage that less components are required and that the installing of the luminaire is simplified.

The invention yet further relates to a method of suspending a luminaire according to the invention, the method comprising the steps of:

- bringing at least two hooks in a respective further rotational position;
- hooking each loop portion onto an associated, respective support (of a false ceiling);
- electrically connect the luminaire to electrical power means;
- pushing the luminaire towards the supports to bring the hooks essentially in a respective first rotational position is in a relatively low tension state (and to render it to be mounted flush with the ceiling).

The invention still further relates to a method of demounting a luminaire according to the invention, the method comprising the steps of:

- pushing a first end of the luminaire towards a respective support (to make another end of the luminaire to protrude from the ceiling);
- pulling a second end of the luminaire away from its respective support and while doing this pulling the first end away from its respective support;
- bringing both hooks in a respective further rotational position;
- perform servicing or further dismounting operations (like electrical disconnection).

The abovementioned methods render respectively easy suspending of a (electrical) device, such as a lighting device, for example a luminaire, and respectively easy demounting of a (electrical) device, such as a lighting device, for example a luminaire.

BRIEF DESCRIPTION OF THE DRAWINGS

The invention will now be further explained and elucidated by means of the schematic drawings, which are intended to illustrate rather than to limit the scope of the invention. Thereto in the drawings.

DETAILED DESCRIPTION OF PREFERRED EMBODIMENTS

Figure 1:
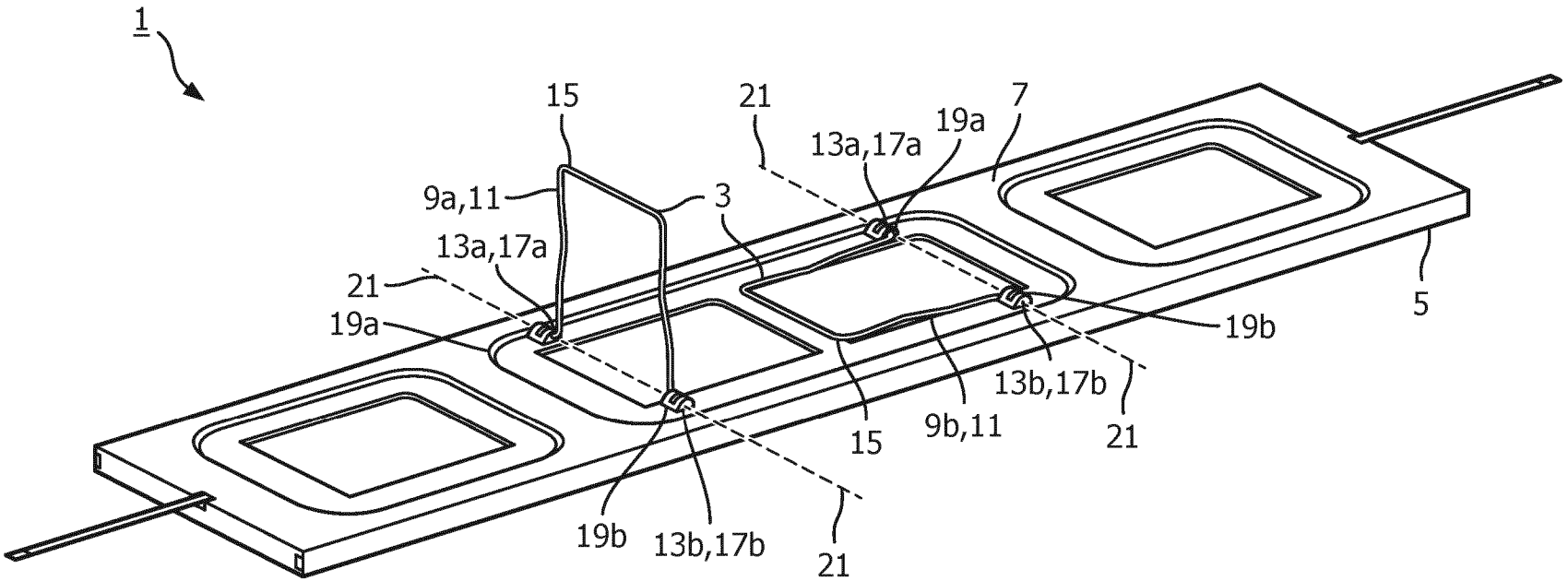
FIG. 1 shows a perspective view of a first embodiment of a luminaire according to the invention.

FIG. 1 shows a perspective view of a first embodiment of a luminaire 1 according to the invention. The luminaire 1 comprises two suspension means 3 and a housing 5 comprising a top wall 7. Each suspension means 3 comprises two hooks 9*a,b* each formed of an elastic wire 11 of a cross-sectional diameter Dw (see FIG. 4A) and having two remote, essentially oppositely arranged end portions 13*a,b* mutually connected by a loop portion 15. Each end portion 13*a,b* forms a respective spindle 17*a,b* with length Ls (see FIG. 4B). Each suspension means 3 further comprises two elongated channel elements 19*a,b* substantially axially arranged along a respective rotation axis 21. The channel elements 19*a,b* are integrally formed with the top wall 7 of the housing 5 of the luminaire 1. As shown and better visible in FIG. 2A, in an assembled configuration of housing 5 and suspension means 3, the channel elements 19*a,b* of said suspension means 3 are mounted on the top wall 7, and at least a portion 23*a,b* of a respective spindle 17*a,b* is accommodated with a snugly fit in a respective channel 25*a,b* of a respective channel element 19*a,b*. Further to FIG. 2A, both the spindles 17*a,b* and the channels 25*a,b* are mutually misaligned at misalignment angle α, each with a half misalignment angle 0.5α with respect to the rotation axis 21. As shown, the misalignment of the spindles and the axes is the same. The misalignment renders the hook 9*b* to be in a relatively low tension state when in a first rotational position 27, and renders hook 9*a* to be in a relatively high tension state when in further rotational positions 29, of which one further rotational position is shown. In said further rotational position 29 the hook 9*a* is urged to rotate back to the first rotational position 27.

Figure 2A:
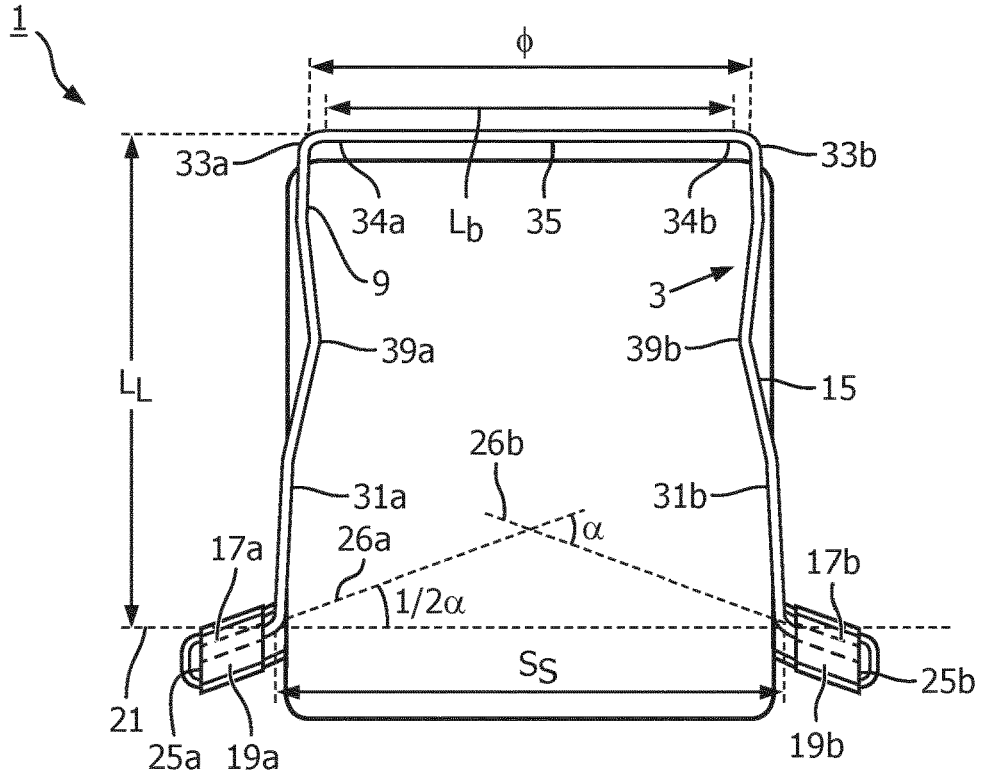
FIG. 2A-B show a respective top view of two different embodiments of luminaires of the invention.
Figure 2B:
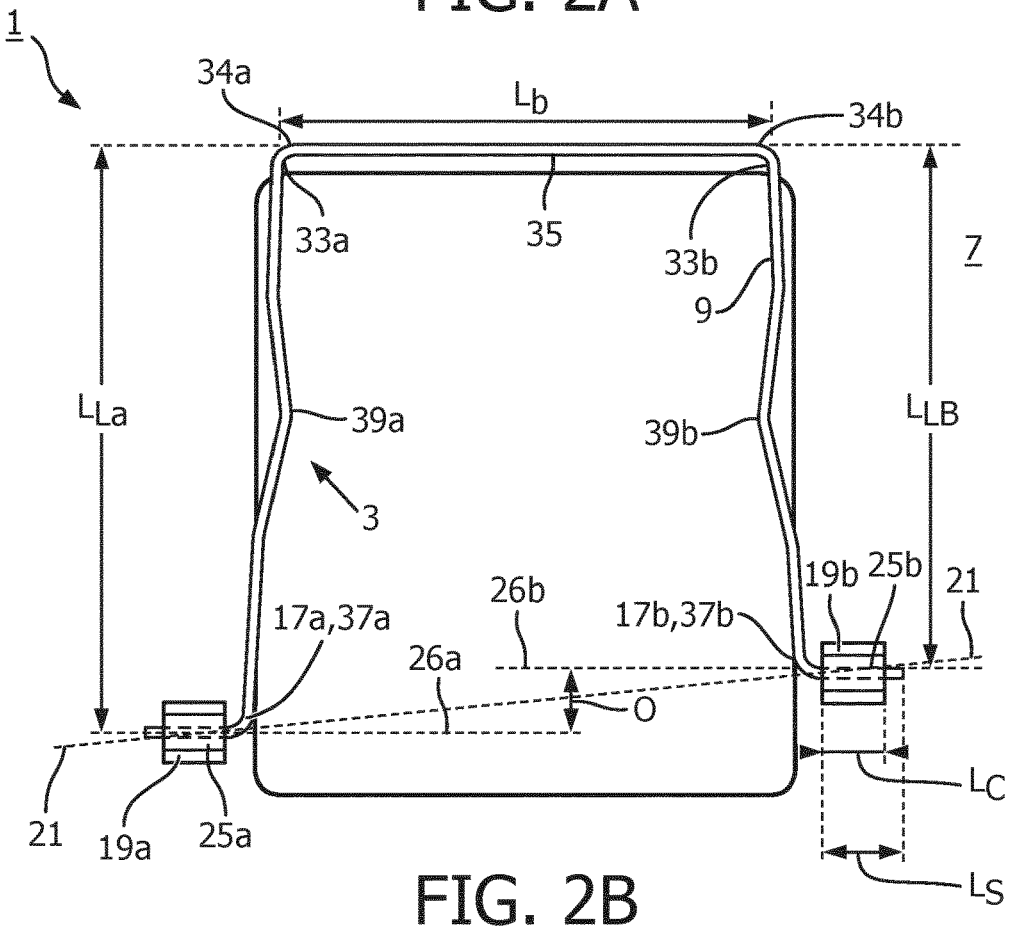

FIG. 2A-B show a respective top view of two different embodiments of suspension means 3 of luminaires 1 of the invention, only one suspension means 3 is shown for a luminaire. The suspension means 3 comprises a loop portion 15 comprising a hook 9 having two spindles 17*a,b* pointing away from each other and the suspension means 3 comprises two channel elements 19*a,b* each with a respective channel 25*a,b*. FIG. 2A shows a part of the luminaire 1 wherein the spindles 17*a,b* each have a respective spindle axis 26*a,b*. The spindles 17*a,b* (and the channels 25*a,b*) are mutually misaligned at a misalignment angle α, wherein a 35°, and the spindles are spaced apart by a spindle spacing Ss, wherein Ss=Lb+0.1*Ll, with Lb is the bridge length and Ll is the length of the legs portions 31,31*b*. FIG. 2B shows a part of another embodiment of luminaire 1 in which both the channels 25*a,b* and the spindles 17*a,b* have a mutual offset O of the spindle axes 26*a,b*, wherein O≈15 mm. Neither the spindles 17*a,b* nor the channels 25*a,b* are misaligned, i.e. the misalignment angle α is zero. The channel elements 19*a,b* are welded to a top wall 7 of the housing 5 of the luminaire 1. Each channel has a length Lc, wherein Lc=0.8*Ls, with Ls being the length of a spindle.

Both in FIGS. 2A and 2B is shown that each hook 9 further comprises two leg portions 31*a,b* (or legs), each with a length Ll, for example about 25 cm, and mutually connected by respective second end portions 33*a,b* via respective bridge ends 34*a,b* to a bridge portion 35 (or bridge). Please note that in FIG. 2B the leg portions 31*a,b* have a mutually different length of respectively Lla and Llb, i.e. Lla−O=Llb and the hook 9 is shaped such that when the hook 9 is in the first rotational position and rests on the housing wall 7, it is essentially tension free, while when the hook 9 is in one of the further rotational positions, it is in a relatively high tension state and urged back to the first rotational position. The spindles 17*a,b* of the hook 9 are formed by first end portions 37*a,b* of the legs 31*a,b* and are (at least partly) accommodated in the respective channels 25*a,b* of the channel elements 19*a,b*. The legs 31*a,b* of a single hook 9 are extending essentially mutually parallel, i.e. in the embodiments shown extend at a mutual angle Φ of about plus or minus 6°. Furthermore, each leg 31*a,b* is provided with a respective kink/protrusion/indent/step 39*a,b* which provides a semi-stable suspension position when the luminaire is suspended from a false ceiling. The bridge 35 has bridge length Lb that scales with the length Ll of the leg portion, in the figure Lb=0.85*Ll.

Figure 3:
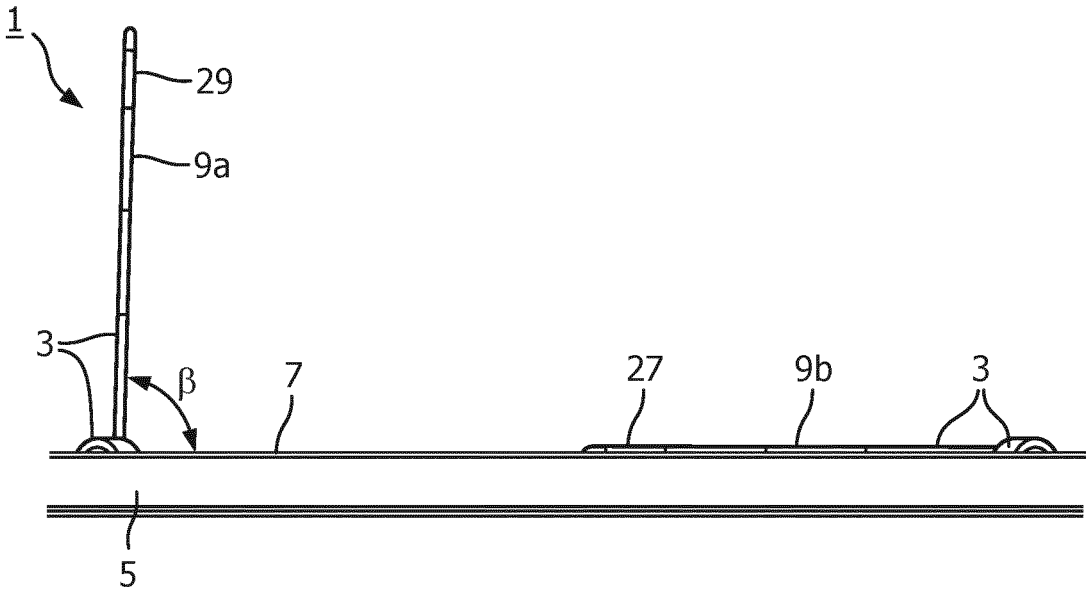
FIG. 3 shows a side view of the luminaire of FIG. 1.

FIG. 3 shows a side view of the luminaire 1 as shown in FIG. 1, with one hook 9*b* of the suspension means 3 in a relatively low tension state in a first rotational position 27 at angle β of 0° with a flat surface of the top wall 7 of the housing 5 of the luminaire 1. The other hook 9*a* of the suspension means 3 is in a relatively high tension state in a further rotational position 29, i.e. at an angle β of almost 90° with the flat surface of the top wall 7 of the housing 5 of the luminaire 3. Both hooks 9*a,b* have a two-dimensional shape, i.e. are embodied as flat parts that each extend in a respective virtual plane P.

Figure 4A:
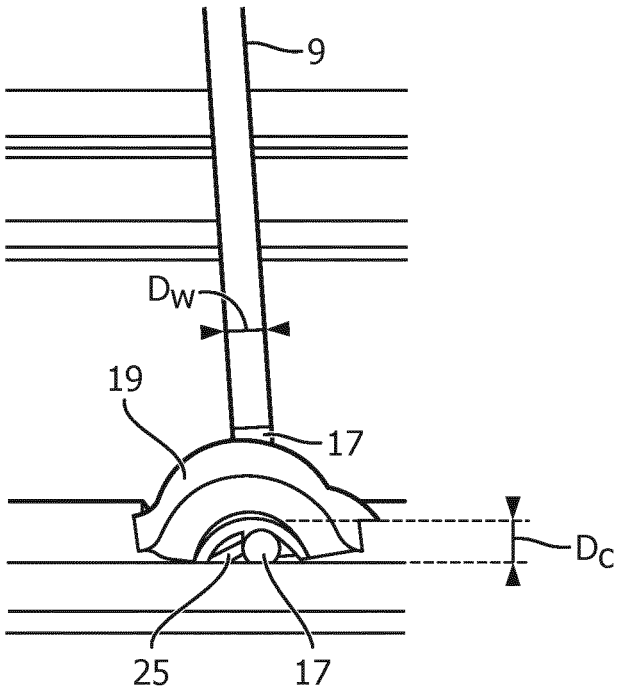
FIG. 4A-B shows details on spindle and channel element of a suspension means according to the invention.
Figure 4B:
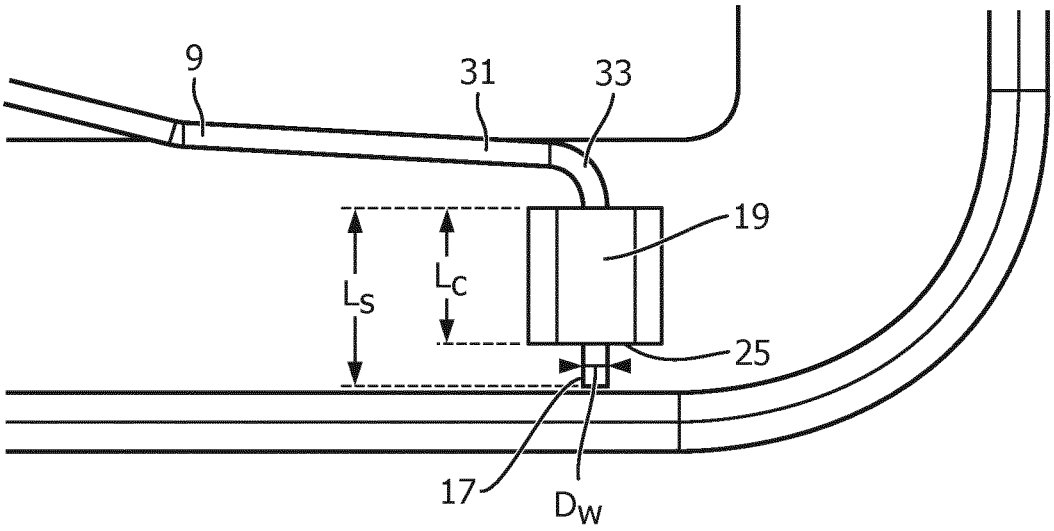

FIG. 4A-B shows details of a spindle 17 and a channel element 19 of a hook 9 of a suspension means according to the invention. In FIG. 4A it is shown that the hook 9 has diameter Dw and that the channel 25 in the channel element 19 has an inner diameter Dc, with Dc being slightly larger than Dw, in the figure Dc=1.03*Dw, for accommodating the spindle 17 with a snugly fit. In FIG. 4B it is shown that the spindle 17 is connected at a second end portion 33 of the leg portion 31 of the hook 9 and has a length Ls. The spindle 17 is accommodated in the channel 25 of the channel element 19 over a length of Lc, wherein Lc is at least 60% of Ls, in the figure Lc=0.75*Ls. Both Ls and Lc are a multiple of the wire diameter Dw, i.e. in the figure Lc=6*Dw.

Figure 5A:
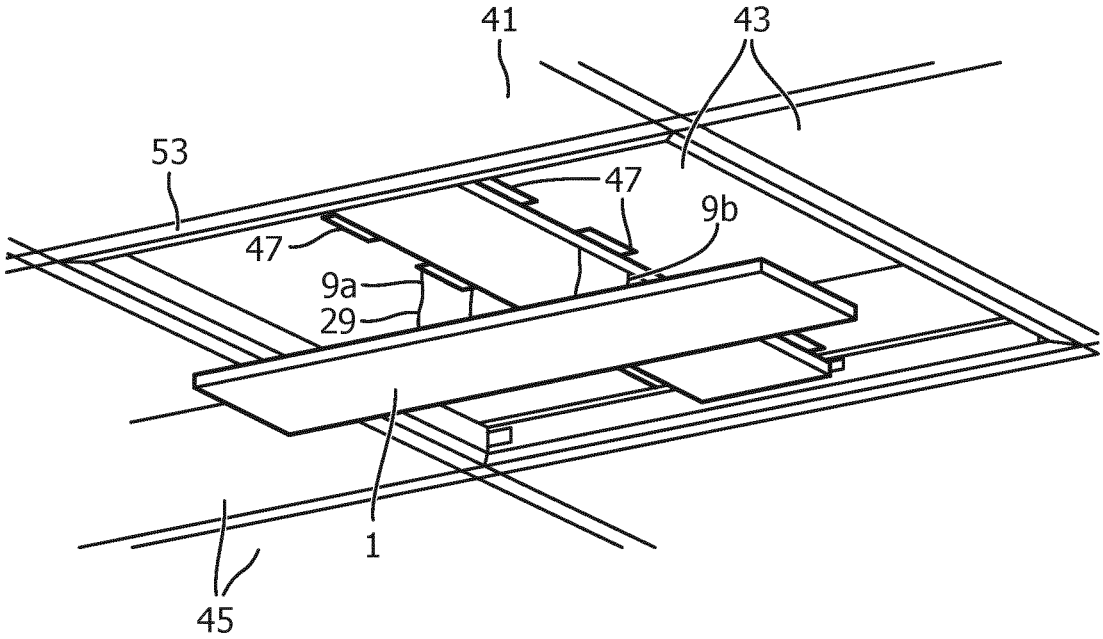
FIG. 5A-C shows several stages of suspending and demounting of a luminaire according to the invention.
Figure 5B:
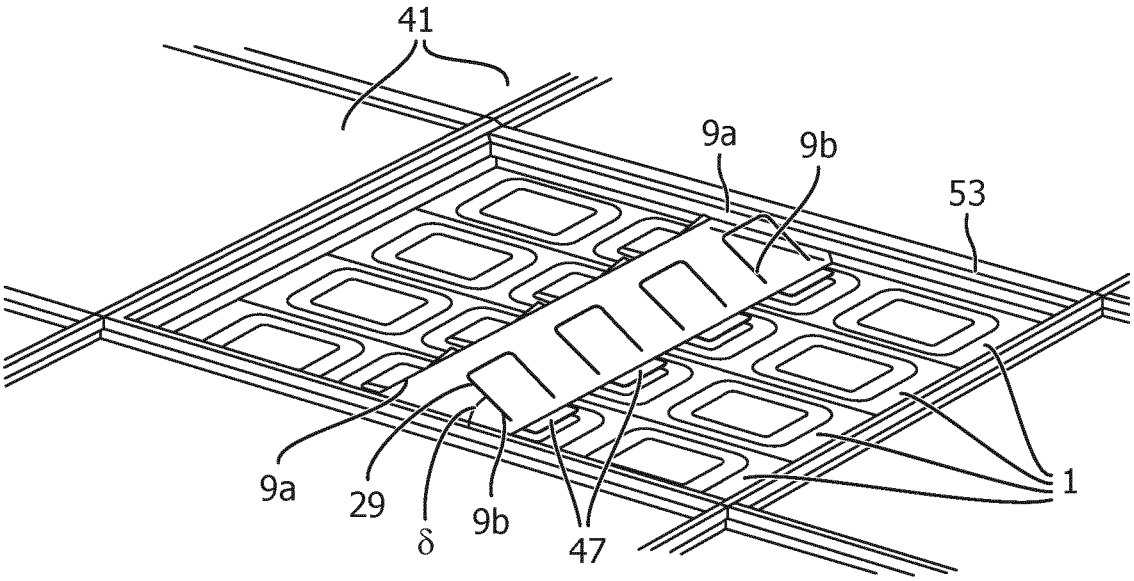
Figure 5C:
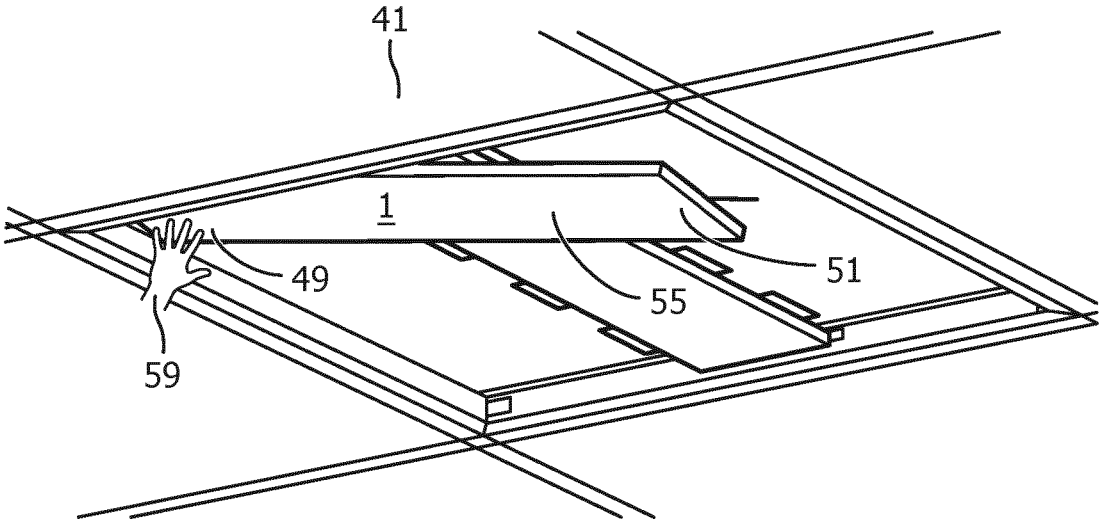

FIG. 5A-C shows several stages of suspending and demounting of a luminaire 1 according to the invention. FIG. 5A shows bottom view of a false ceiling, i.e. from a position below the false ceiling 41. The false ceiling 41 comprises a grid shaped carrier structure of T-bars 53, resulting in a subdivision of the false ceiling 41 into rectangular or square shaped spaces 43 in which ceiling tiles 45 can be mounted. In the figure in one of said rectangular spaces 43 is left open for mounting four luminaires 1. FIG. 5A shows mounting of the luminaire 1 is a first stage, i.e. the luminaire 1 is suspended from the false ceiling 41 in a lowered position with the hooks 9*a,b* of the suspension means 3 in a semi-stable further rotational position 29 hooked on mounting elements 47 of the false ceiling 41. FIG. 5B shows a top view of four modular luminaires 1 in a mounted, second stage wherein the four luminaires 1 fill up in a flush manner a rectangular space 43 in the false ceiling 41. The hooks 9*a,b* of the suspension means 3 of the luminaires 1 are hooked around respective mounting elements 47 of the false ceiling 41 and are in further rotational positions 29 at a relatively small angle δ from the first rotational position. As a result the luminaires 1 are urged to rest with a permanent pressure against the T-bar carrier structure 53 of the false ceiling 41. FIG. 5C shows a demounting stage of the luminaire 1 of the situation shown in FIG. 5B, i.e. already three luminaires have been demounted and a fourth luminaire 1 is pressed by hand 59 at one luminaire end 49, indicated with respect to luminaire center 55, into the false ceiling 41, causing the other luminaire end 51 to protrude towards below from the false ceiling 41. Said other luminaire end 51 subsequently can be gripped by the servicing person to pull the luminaire 1 into its lowered mounted position from the false ceiling 41 for servicing the luminaire 1 or removal of the luminaire 1 from the false ceiling 41.

Figure 6:
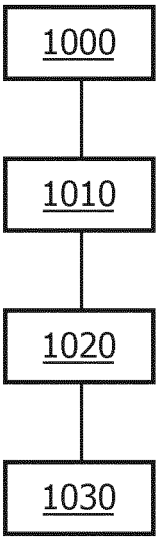
FIG. 6 shows a schematic flow diagram of a first method according to the invention.
Figure 7:
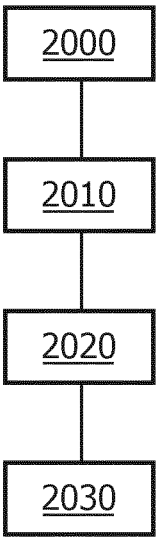
FIG. 7 shows a schematic flow diagram of a second method according to the invention.

FIG. 6 shows a schematic flow diagram of a first method according to the invention. The method comprising the steps of:

- 1000: bringing at least two hooks in a respective further rotational position;
- 1010: hooking each loop portion onto an associated, respective support. Such a support can be comprised in a false ceiling as shown in FIGS. 5A-C;
- 1020: electrically connect the luminaire to electrical power means;
- 1030: pushing the luminaire towards the supports to bring the hooks essentially in a respective first rotational position is in a relatively low tension state. In said relatively low tension state the luminaire can be mounted flush with a false ceiling, see for example FIG. 5B FIG. 7 shows a schematic flow diagram of a second method according to the invention, the method comprising the steps of:

- 2000: pushing a first end of the luminaire towards a respective support. An example of this step is shown in FIG. 5C, wherein said pushing at one end makes another end of the luminaire to protrude from the ceiling;

2010: pulling a second end of the luminaire away from its respective support and while doing this pulling the first end away from its respective support;

2020: bringing both hooks in a respective further rotational position;

2030: perform servicing or further dismounting operations, for example electrical disconnection.

The invention claimed is:

1. Suspension means suitable for use in a luminaire, said suspension means comprising:

a hook formed of an elastic wire of a cross-sectional diameter Dw and having two remote, essentially oppositely arranged end portions mutually connected by a loop portion, each end portion forming a spindle with length Ls, a base comprising two elongated channel elements axially arranged along a rotation axis, wherein in an assembled configuration of hook and base, at least a portion of a respective spindle is accommodated with a snugly fit in a respective channel of a respective channel element, and the spindles and/or the channels are mutually misaligned with respect to the rotation axis for the hook to be in a relatively low tension state when in a first rotational position, and to be in a relatively high tension state when in further rotational positions and wherein the hook is urged to rotate to assume the first rotational position.

2. Suspension means as claimed in claim 1, wherein the hook is shaped as an essentially two-dimensional body.

3. Suspension means as claimed in claim 1, wherein the loop portion comprises a bridge portion and two substantially parallel leg portions extending in the same direction, the bridge portion having two bridge ends, a respective end portion as the spindle, the two leg portions are connected by a respective first leg end to a respective bridge end.

4. Suspension means as claimed in claim 3, wherein at least one leg portion has a profiled structured portion selected from a group consisting of a kink, a protrusion, an indent, and a step.

5. Suspension means as claimed in claim 1, wherein each spindle has a respective spindle axis and wherein the spindle axes are mutually angled at a misalignment angle $\alpha$ in the range of $5° <= \alpha <= 30°$.

6. Suspension means as claimed in claim 1, wherein each spindle has a respective spindle axis, wherein the spindle axes extend mutually essentially parallel and are mutually offset by an offset O, said offset O being n times the cross sectional diameter Dw of the elastic wire, with $2 <= n <= 15$.

7. Suspension means as claimed in claim 1, wherein said length Ls of each spindle is m times the cross sectional diameter Dw of the elastic wire, with $2 <= m <= 15$.

8. Suspension means as claimed in claim 1, wherein the channel elements each comprise a respective channel having a length Lc, with $Lc >= 0.6*Ls$.

9. Suspension means as claimed in claim 1, wherein at least 70% of each spindle is extending in a respective, associated channel element.

10. Luminaire comprising the suspension means according to claim 1 and a housing comprising a top wall.

11. Luminaire as claimed in claim 10, wherein the top wall comprises a major, flat surface on which the channel elements are provided, and wherein in the first rotational position of the relatively low tension state the loop portion of the hook extends essentially parallel to said flat surface.

12. Luminaire as claimed in claim 10, wherein the channel elements are integrally formed with the top wall of the luminaire.

13. Method of suspending a luminaire as claimed in claim 10, the method comprising the steps of:

bringing at least two hooks in a respective further rotational position having a relatively high tension state;

hooking each loop portion onto a respective section of a false ceiling;

electrically connect the luminaire to electrical power means;

pushing the luminaire towards the supports to bring the hooks essentially in a respective first rotational position is in a relatively low tension state and to render it to be mounted flush with the ceiling.

14. Method of demounting a luminaire as claimed in claim 10, the method comprising the steps of:

pushing a first end of the luminaire towards a respective support to make another end of the luminaire to protrude from the ceiling;

pulling a second end of the luminaire away from its respective support and while doing this pulling the first end away from its respective support;

bringing both hooks in a respective further rotational position;

perform servicing or further dismounting operations, including electrical disconnection.

* * * * *